US006386793B1

(12) United States Patent
Lenz et al.

(10) Patent No.: US 6,386,793 B1
(45) Date of Patent: May 14, 2002

(54) DEVICE FOR SMOOTHING A CONCRETE PAVING SURFACE

(75) Inventors: Martin Lenz, Dernbach; Holger Thieme, Linz/Rheim; Karl-Heinz Runkel, Honnef-Rhoendorf, all of (DE); Raymond Smolders, Herentals (BE)

(73) Assignee: Wirtgen GmbH, Windhagen (DE)

( * ) Notice: Subject to any disclaimer, the term of this patent is extended or adjusted under 35 U.S.C. 154(b) by 0 days.

(21) Appl. No.: 09/493,132

(22) Filed: Jan. 28, 2000

(30) Foreign Application Priority Data

Jan. 29, 1999 (DE) ..... 199 03 638

(51) Int. Cl.[7] ..... E01C 19/12; E01C 19/22

(52) U.S. Cl. ..... 404/96; 404/101; 404/105; 404/118

(58) Field of Search ..... 404/96, 101, 102, 404/105, 118, 119

(56) References Cited

U.S. PATENT DOCUMENTS

| | | | | | |
|---|---|---|---|---|---|
| 1,782,707 | A | * | 11/1930 | Bayley | 404/96 |
| 2,094,910 | A | * | 10/1937 | Baily | 404/96 |
| 2,603,132 | A | * | 7/1952 | Miller et al. | 404/119 |
| 2,779,258 | A | * | 1/1957 | Johnson | 404/105 |
| 2,999,433 | A | * | 9/1961 | Baltes | 404/96 |
| 4,073,592 | A | * | 2/1978 | Godberson et al. | 404/89 |
| 4,379,683 | A | * | 4/1983 | Rodgers et al. | 425/62 |
| 4,900,186 | A | * | 2/1990 | Swisher, Jr. et al. | 404/105 |
| 5,061,115 | A | * | 10/1991 | Godbersen et al. | 404/102 |
| 5,101,360 | A | * | 3/1992 | Bennett | 364/505 |
| 5,356,238 | A | * | 10/1994 | Musil et al. | 404/84.1 |
| 5,879,104 | A | * | 3/1999 | Ulrich | 404/102 |

FOREIGN PATENT DOCUMENTS

| | | | |
|---|---|---|---|
| DE | 3036234 C2 | | 2/1982 |
| GB | 2 080 374 A | * | 2/1982 |

* cited by examiner

*Primary Examiner*—Gary S. Hartmann
(74) *Attorney, Agent, or Firm*—Diller, Ramik & Wight

(57) ABSTRACT

A device for smoothing a concrete paving surface including a machine frame that defines a predetermined working width perpendicular to a predetermined direction of travel of the machine frame, and a carriage system for moving the machine frame in the predetermined direction of travel. The device also includes a transverse smoothing portion carried by the machine frame for smoothing concrete paving across the predetermined working width that has two transverse structures with adjacent ends and remote ends and an articulating portion for connecting together the adjacent ends of the transverse structures. The device further includes a longitudinal smoothing portion for effecting longitudinal smoothing of concrete paving, and a moving portion for moving the longitudinal smoothing portion along the transverse structures over the entirety of the predetermined working width.

24 Claims, 3 Drawing Sheets

DEVICE FOR SMOOTHING A CONCRETE PAVING SURFACE

BACKGROUND OF THE INVENTION

The present invention relates to a device for smoothing a concrete paving surface after the finishing of fresh concrete.

Such devices are needed to make road surfaces from concrete. They may be integrated as an element of a slip form paver or they may be used as a mounted implement of a slip form paver or another road construction machine with a tractor.

Slip form pavers are used to make concrete-paved surfaces, such as roads, concrete runways or the like, with continuous advance. From a truck or with the use of special apparatus, such as charging devices, fresh concrete is poured in front of the slip form paver. Using a distributing screw or a distributing knife, the concrete is first spread evenly transverse to the traveling direction. Thereafter, the concrete is compacted using vibrator means and shaped with a finishing pan to take the desired monolithic profile. Behind the finishing pan, a transverse smoothing means is generally provided that substantially consists of a rigid board reciprocated transverse to the traveling direction, thus smoothing slight irregularities in the still fresh concrete paving. A longitudinal smoothing means is arranged downstream of the transverse smoothing means, which provides an additional smoothing to the still fresh concrete paving.

From German Patent 30 36 234, a device for smoothing a concrete paving surface is known that employs a transverse and a longitudinal smoothing means to remove irregularities in the fresh concrete. The transverse smoothing means consists of a shuttle board located immediately behind a finishing pan. The shuttle board is adjustable in height by two handwheels. The shuttle movement of the shuttle board is caused by an eccentric drive. The longitudinal smoothing means is a smoothing metal sheet hinged on a carriage by means of two pairs of struts, the carriage being movably supported on a cross beam and being displaceable transverse to the traveling direction across the width of the machine. This cross beam is fixedly connected to the machine frame through cantilever arms and it is arranged far behind the transverse smoothing means, seen in the traveling direction. An eccentric drive reciprocates the smoothing metal sheet parallel to the traveling direction. The support of the longitudinal sheet is designed such that the movement of the longitudinal sheet is adapted to the surface contour of the fresh concrete.

It is a disadvantage of this device that the space required by the arrangement of the transverse smoothing means and the longitudinal smoothing means is rather large. The fact that the longitudinal smoothing means extends very far to the rear end—seen in the traveling direction—requires the provision of an additional support for the longitudinal smoothing means. Another problem is that the known longitudinal smoothing means cannot be used when the profile of the concrete paving surface is roof-shaped.

SUMMARY OF THE INVENTION

It is the object of the present invention to provide a device of the type mentioned above that allows a working means to be displaced across the entire working width even if the concrete paving surface is roof-shaped.

Advantageously, according to the present invention, the transverse smoothing means for making a roof-shaped profile of the concrete paving surface consists of two transverse smoothing boards hingedly connected at the center of the working width, and a working means is movably attached to the transverse smoothing means and is movable on the transverse smoothing means across the entire working width of the machine frame. Thus, the invention provides that the transverse smoothing means serves as a guiding means for an additional working means adapted to be displaced across the working width. Thereby, the structural length of the machine can be reduced significantly and an additional cross beam used as a guiding means for the working means can be omitted. Further, it is guaranteed that the working means will exactly follow the roof-shape of the concrete paving surface defined by the transverse smoothing means. When mounting prolongating segments with a working width up to 16 m, the guiding means for the working means is prolonged at the same time without any further rearrangements.

Preferably, the transverse smoothing means comprises a carriage movable across the entire working width of the machine frame, the working means being mounted on the carriage. Thus, the transverse smoothing means serves as a guiding means for a carriage, the guiding means preferably consisting of rails on which the rollers of the carriage can run.

In a preferred embodiment, the rail ends facing each other are provided with a track segment extending parallel to the rails, the track segment bridging the gap occurring between the rails when setting a roof-shaped profile of the concrete paving surface, and the carriage has twin rollers that take support on the rails, as well as on the track segment. The track segment allows for a smooth passage from the guiding means of one transverse smoothing board to the guiding means of the other transverse smoothing board. Thus, the working means can be moved across the working width such that it exactly follows the roof-shaped profile of the concrete paving surface.

The track segment is preferably fastened to one of the two transverse smoothing boards. In order to distribute the load, it is also possible to divide the track segment into two parts, the part with the upper guiding means being mounted to one of the transverse smoothing boards, while the other part of the track segment with the lower guiding means is fixed to the other transverse smoothing board. Here, the two track segments may be slidably supported at each other.

Preferably, the transverse smoothing means is pendulously suspended at the machine frame via coupling members. Thus, a swinging transverse movement of the transverse smoothing means is made possible.

Preferably, the transverse smoothing means is suspended at the machine frame in the manner of a parallelogram.

The working depth and the longitudinal angle of inclination of the transverse smoothing means may be adjusted continuously. The longitudinal angle of inclination refers to an adjustment angle of the transverse smoothing means in the traveling direction.

In a particularly preferred embodiment, the working means is a longitudinal smoothing means. The invention is particularly advantageous for use with a longitudinal smoothing means. In a longitudinal smoothing means that requires a large space, reducing the structural length is an important advantage.

Preferably, the drive required for moving the working means transversely across the working width is arranged on a structural member that is stationary relative to the machine frame, not on the transverse smoothing means.

Here, the longitudinal smoothing means may be adjusted independent of the transverse smoothing means. This is of importance in preventing interferences of the movements of the transverse smoothing means and the longitudinal smoothing means.

Preferably, the device is integrated in a slip form paver so that the structural length thereof can be reduced significantly. The device may also be mounted as an add-on device on another road construction machine, or it may be an independent machine with running gears of its own.

Various features and advantages of the present invention will become evident from the following description of a preferred embodiment taken in conjunction with the accompanying drawings.

BEST MODE OF CARRYING OUT THE INVENTION

Figure 1:
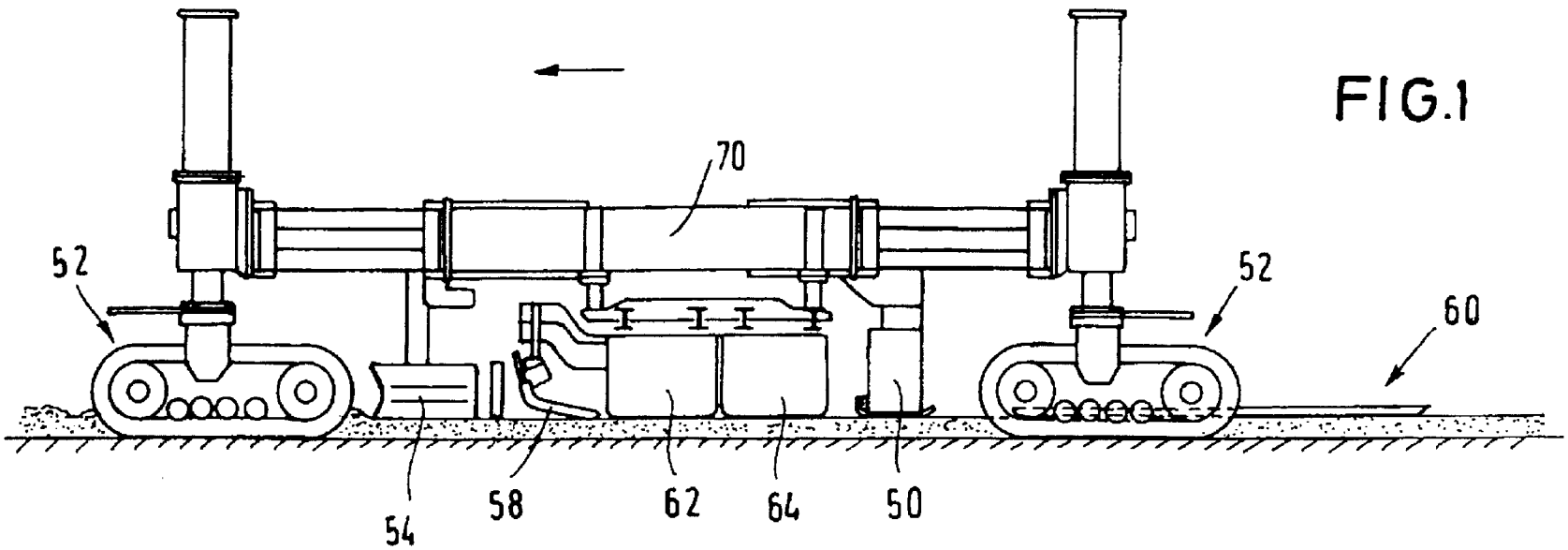
FIG.1 PRIOR ART
FIG. 1 illustrates a slip form paver according to prior art.

FIG. 1 illustrates a slip form paver with a machine frame 70 supported by carriages 52, where working means 50, 54, 58, 60, 62, 64 are fastened to the machine frame. In particular, the working means are a distributing knife 54 adapted to be reciprocated along the working width, a vibrator means 58, two successively arranged finishing pans 62, 64, as well as a transverse smoothing means 50 and a longitudinal smoothing means 60.

The transverse smoothing means 50 is fastened adjustable in height to the machine frame 70 and, due to an eccentric drive 22, 23, may perform oscillating movements transverse to the traveling direction of the slip from paver.

Further, the rear end—seen in the traveling direction—of the prior art slip form paver is provided with a longitudinal smoothing means 60 that is separate from the transverse smoothing means 50 and may be reciprocated over the entire working width of the machine using a carriage.

Figures 2, 4:
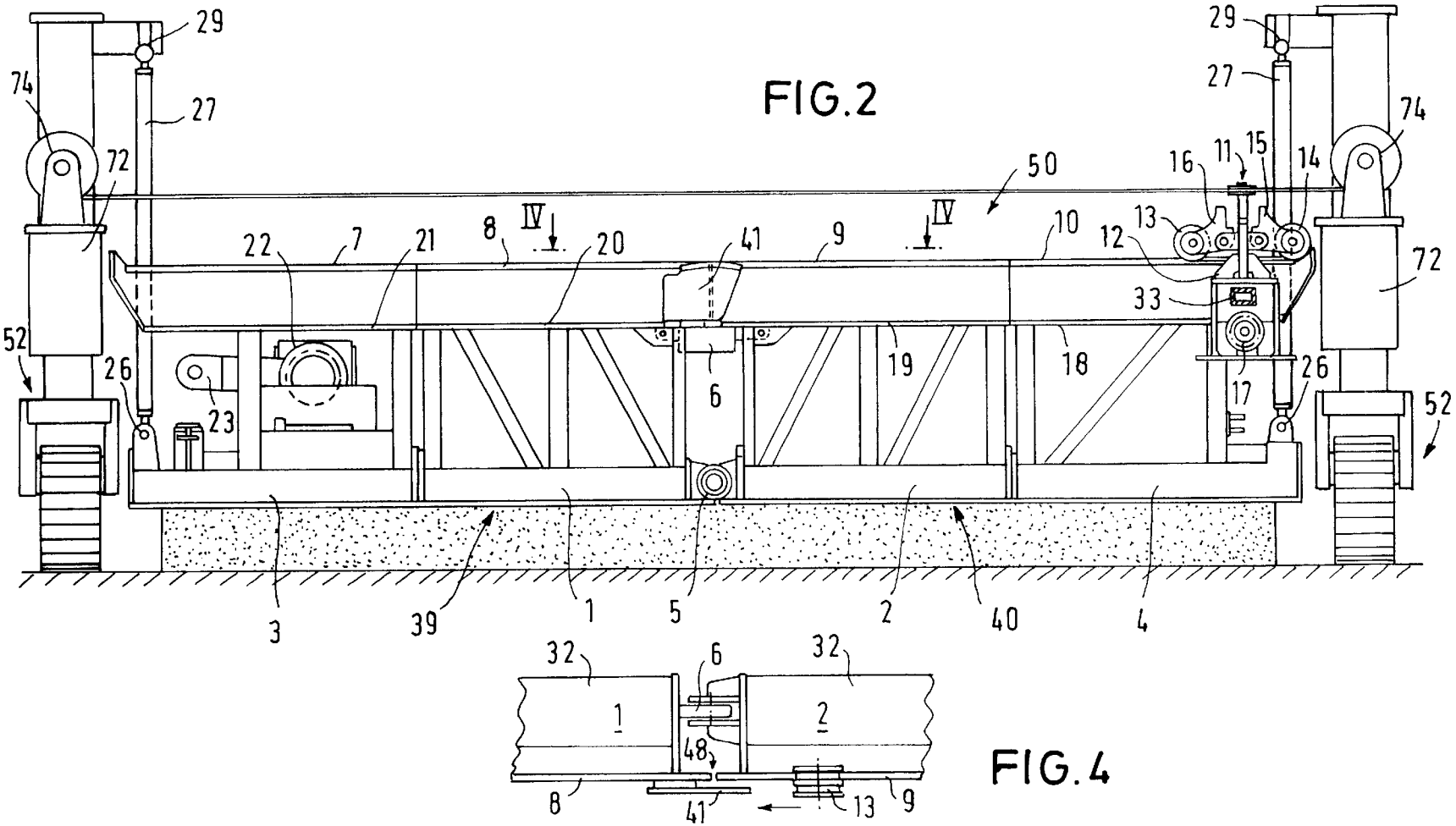
FIG. 2 illustrates a transverse smoothing means with an integrated guiding means for an additional working means.
FIG. 4 is a plan view along line IV—IV in FIG. 2.

FIG. 2 illustrates a combined transverse and longitudinal smoothing means 50 according to the present invention in a rear end view, seen in the traveling direction. The transverse smoothing means 50 consists of two articulately connected transverse smoothing boards 39, 40. The transverse smoothing boards 39, 40 in turn are comprised of a plurality of board segments 1 to 4, the outer board segments 3, 4 being adapted to be mounted with different structural widths so as to adjust the width of the transverse smoothing means 50 to different working widths. In order to make a roof-shaped profile of the concrete paving surface, the inner board segments 1 and 2 are connected through a pivot joint 5. The inclination of the roof-shaped profile is set using an adjusting means 6 arranged between the upper ends of the board segments 1 and 2 and adapted to push these apart to set an inclination of the roof-shaped profile. The upper end of the board segments 1 to 4 averted from the concrete paving surface, are provided with guiding means made up from rails 7 to 10; 18 to 21, the guiding means being provided for a carriage 11 in an upper part 32 of the board segments 1 to 4. The carriage 11 comprises two upper rollers 13, 14, as well as at least one lower roller 17. The rollers 13, 14 run on the upper rails 7 to 10, while the lower roller 17 runs on the lower rails 18 to 21.

Figure 3:
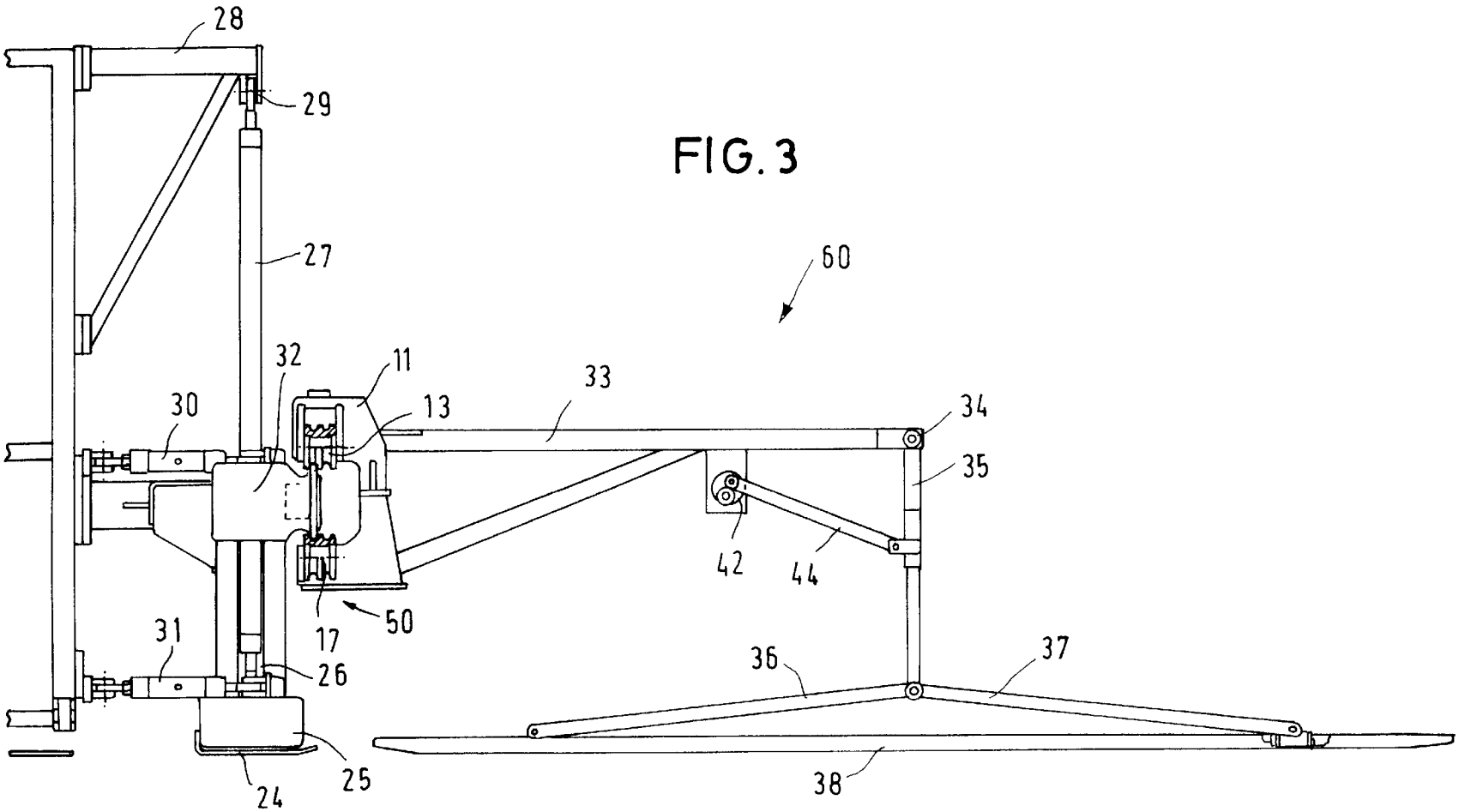
FIG. 3 shows a combined transverse and longitudinal smoothing means.

FIG. 3 is a side elevational view of the combined transverse and longitudinal smoothing means 50, 60. The smoothing unit of each board segment 1 to 4 comprises a metal transverse smoothing plate 24 attached to the lower part 25 of each board segment 1 to 4. On the outer side of each lower part 25 of the outer board segments 3, 4 a pivot joint 26 is arranged to which a coupling member 27 is articulately connected. The coupling member 27 is pivotably supported on a cantilever arm 28 through a pivot joint 29, the cantilever arm 28 possibly being additionally fastened to the lifting column 72 of the carriage 52. This kind of suspension allows for a swinging movement of the board segments 1 to 4 transverse to the traveling direction. Since the suspension is in the form of a parallelogram guiding, the transverse smoothing board segments 1 to 4 always move in parallel. The pendulum stroke is about ±30 mm transverse to the traveling direction. The pendulum movement has a frequency of about 1 Hz. The pitch of the board segments 1 to 4 is adjusted using the substantially horizontal spindles 30, 31. The pendulum movement of the board segments 1 to 4 is generated by an eccentric drive 22 which, in FIG. 2, is located in the board segment 3. The eccentric drive 22 is connected to the machine frame 70 through a coupling link 23.

The carriage 11 of the longitudinal smoothing means 60 runs on the upper parts 32 of the board segments 1 to 4 that support the guiding means formed by the rails 7 to 10 and 18 to 21. A cantilever arm 33 is fastened to the carriage 11. A beam 35 is fastened to a joint 34 on the cantilever arm 33, the beam being articulately connected with one end of two coupling struts 36, 37. At their other ends, the coupling struts 36, 37 are articulately connected with a metal longitudinal smoothing plate 38. This articulate suspension of the metal longitudinal smoothing plate 38 allows for an adaptation to the surface contour of the fresh concrete parallel to the traveling direction of the device. A push-rod 44 connects the beam 35 with an eccentric drive 42 so that the beam performs a reciprocating swinging movement parallel to the traveling direction of the vehicle.

Due to the fact that the longitudinal smoothing means 60 may be displaced on the transverse smoothing means transverse to the traveling direction by means of rope drum drives 74, fastened to the lifting columns 72 of the rear carriages 52, and a traction rope 76, the movements of the transverse smoothing means are not transferred to the longitudinal smoothing means.

The carriage 11 can be reciprocated by rope drum drives stationarily mounted on the machine frame 70 or the rear lifting columns 72 so that the movement of the longitudinal smoothing means 60 can be adjusted independent of the movement of the transverse smoothing means 50.

FIG. 4 is a plan view of a portion of FIG. 2. At their upper parts 32, the board segments 1 and 2 are very close when the angle of inclination of the roof-shaped profile is set to about 0° so that only a small gap 48 remains between the rails 8, 9 and 18, 19. When the adjusting means 6 is actuated, the upper parts 32 of the board segments 1 and 2 are pushed apart so that the gap 48 widens substantially. To bridge this gap 48, a track segment 41 extends parallel to the rails 8, 9; 19, 20, which, in FIG. 1, is attached to the board segment 1. The track segment 41 has an upper and a lower rail section with a cross-sectional profile corresponding to that of the rails 8, 9; 19, 20. The rollers 13, 14, 17 of the carriage 11 are twin rollers, as illustrated in FIG. 4, one roller groove being supported on the rails 7 to 10; 18 to 21, while the other roller groove being supported on the track segment 41. Thus, even when a large angle of inclination is set for the roof-shaped concrete profile, the carriage 11 is always supported such that carriage 11 may be moved across the entire working width, even if a large gap 48 exists between the rails 8, 9; 19, 20 of the transverse smoothing boards 39, 40.

What is claimed is:

1. A device for smoothing a concrete paving surface comprising a machine frame defining a predetermined working width substantially perpendicular to a predetermined direction of travel, carriage means for moving said machine frame in the predetermined direction of travel, means carried by said machine frame for effecting transverse smoothing of concrete paving substantially across said predetermined working width, said transverse smoothing means including two transverse structures having relatively adjacent ends and remote ends, means for articulately connecting together said transverse structures adjacent ends, longitudinal smoothing means for effecting longitudinal smoothing of concrete paving, and means for moving said longitudinal smoothing means along said transverse structures over the substantial entirety of said predetermined working width.

2. The device as defined in claim 1 wherein the transverse smoothing means includes transition means for guiding the moving means across the transverse structures adjacent ends.

3. The device as defined in claim 2 wherein the longitudinal smoothing means includes a guide carriage, and the transverse smoothing means includes guiding means for guiding the guide carriage over the substantial entirety of said predetermined working width.

4. The device as defined in claim 3 wherein the guiding means includes rails on which the guide carriage is movable.

5. The device as defined in claim 4 wherein at least one of the transverse structures adjacent ends is provided with a track segment extending parallel to the rails for bridging a gap between the rails during the shaping of a roof-shaped concrete paving surface profile, and the guide carriage has a plurality of rollers that may be supported both on the rails and on the track segment.

6. The device as defined in claim 5 wherein the track segment mounted on the adjacent end of said at least one transverse structure is in bridging relationship to said gap irrespective of relatively different articulated positions of said transverse structures adjacent ends.

7. The device as defined in claim 1 wherein the transverse smoothing means is attached to the machine frame by coupling members transverse to the longitudinal traveling direction of the machine frame.

8. The device as defined in claim 1 wherein the transverse smoothing means is shaped substantially as a parallelogram.

9. The device as defined in claim 1 including means for continuously adjusting the working depth and the longitudinal angle of inclination of the transverse smoothing means relative to the longitudinal traveling direction of the machine frame.

10. The device as defined in claim 1 wherein the longitudinal smoothing means is movable across the substantial entirety of said predetermined working width independent of relatively different articulated positions of the transverse structures adjacent ends.

11. The device as defined in claim 1 wherein the longitudinal smoothing means moving means includes at least one rope drum drive and a traction rope.

12. The device as defined in claim 11 wherein the at least one rope drum drive is fastened to said carriage means.

13. The device as defined in claim 11 wherein the at least one rope drum drive is fastened to a rear lifting column of said carriage means.

14. The device as defined in claim 1 wherein the device is a slip form paver.

15. The device as defined in claim 1 wherein said longitudinal smoothing means moving means moves said longitudinal smoothing means independently of the operation of said transverse smoothing means.

16. The device as defined in claim 15 including means for vibrating said longitudinal smoothing means.

17. The device as defined in claim 15 including means for vibrating said longitudinal smoothing means substantially parallel to the predetermined direction of travel.

18. The device as defined in claim 15 wherein said transverse structures each carry a smoothing board.

19. The device as defined in claim 15 including means for vibrating said transverse smoothing means.

20. The device as defined in claim 19 including means for vibrating said longitudinal smoothing means.

21. The device as defined in claim 20 wherein said transverse structures each carry a smoothing board.

22. The device as defined in claim 15 including means for vibrating said transverse smoothing means substantially perpendicular to the predetermined direction of travel.

23. The device as defined in claim 22 including means for vibrating said longitudinal smoothing means substantially parallel to the predetermined direction of travel.

24. The device as defined in claim 23 wherein said transverse structures each carry a smoothing board.

* * * * *